United States Patent [19]

Break et al.

[11] Patent Number: 4,766,757

[45] Date of Patent: Aug. 30, 1988

[54] SHEET BENDING BRAKE

[75] Inventors: Douglas G. Break, Farmington Hills; Walter G. Marsh, Detroit; James J. Rhoades, Garden City, all of Mich.

[73] Assignee: Tapco Products Company, Inc., Detroit, Mich.

[21] Appl. No.: 609,515

[22] Filed: May 11, 1984

Related U.S. Application Data

[63] Continuation of Ser. No. 288,660, Jul. 30, 1981, abandoned.

[51] Int. Cl.[4] ..... B21D 5/04

[52] U.S. Cl. ..... 72/319

[58] Field of Search ..... 72/318–323, 72/316, 293; 269/228, 201, 224, 254 R

[56] References Cited

U.S. PATENT DOCUMENTS

| | | | |
|---|---|---|---|
| 792,136 | 6/1905 | Johnson | 72/321 |
| 1,408,106 | 2/1922 | McCabe | 72/321 |
| 1,512,931 | 10/1924 | Huber | 72/322 |
| 2,612,821 | 10/1952 | Skay | 269/224 |
| 3,180,636 | 4/1965 | Carpenter | 269/224 |
| 3,481,174 | 12/1969 | Barnack | 72/319 |
| 3,482,427 | 12/1969 | Barnack | 72/319 |
| 3,730,116 | 5/1973 | Schramayr | 269/228 |
| 4,237,716 | 12/1980 | Onisko | 72/319 |
| 4,321,817 | 3/1982 | Barnack | 72/319 |

*Primary Examiner*—Daniel C. Crane

*Attorney, Agent, or Firm*—Barnes, Kisselle, Raisch, Choate, Whittemore & Hulbert

[57] ABSTRACT

A sheet bending brake comprising a frame having a fixed jaw and a movable jaw and an anvil member adjustably secured to the movable jaw. The fixed jaw has a clamping surface movable between workpiece clamping and non-clamping positions relative to the clamping surface of the fixed jaw. A bending member is hingedly connected to the fixed jaw. The movable jaw is releasably locked in workpiece clamping position by a structure that includes a plurality of extensible links that are pivoted at one end to the movable jaw and at the other end to a handle. By manipulating the handle the links are moved to move the movable jaw into and out of locked clamping position. Each link is axially adjustable in length to lengthen or shorten it and includes a resilient portion to accommodate manufacturing variations or tolerances in the thickness of the sheet material being bent and to facilitate locking and unlocking of the sheet material.

5 Claims, 3 Drawing Sheets

SHEET BENDING BRAKE

This is a continuation of application Ser. No. 288660, filed July 30, 1981 now abandoned.

This invention relates to sheet bending brakes.

BACKGROUND AND SUMMARY OF THE INVENTION

In U.S. Pat. Nos. 3,161,223, 3,481,174, 3,482,427, 3,559,444, 3,817,075 and 3,872,755, there are disclosed sheet bending brakes for bending metal or plastic sheets as are used in siding on homes and buildings.

In my U.S. application Ser. No. 141,427 filed Apr. 18, 1980 there is disclosed a sheet metal brake comprising a frame having a fixed jaw and a movable jaw and an anvil member adjustably secured to the movable jaw. The movable jaw has a clamping surface movable between workpiece clamping and non-clamping positions relative to the clamping surface on the fixed jaw. A bending member is hingedly connected to the fixed jaw. The movable jaw is releasably locked in workpiece clamping position by a structure that includes an oval shaped spring member having opposed ends and opposed walls. The member is pivoted at one end to the movable jaw and at the other end to a handle for manipulating the jaw.

In such sheet metal brakes it is desirable to provide for bending sheet material of various thicknesses as well as the ability to accommodate manufacturing variations or tolerances in the sheet material.

Among the objects of the present invention are to provide a sheet bending brake of the aforementioned type wherein the sheet bending brake will accommodate manufacturing variations or tolerances in the sheet material without adjustment and will also be adjustable to accommodate variations in thickness of the sheet material and to facilitate locking and unlocking of the sheet material.

In accordance with the invention, a plurality of extensible links are provided between a clamping handle and the movable jaw. Each link includes an axially resilient portion which will accommodate manufacturing variations or tolerances in the sheet material. The link is also axially adjustable in length to accommodate the sheet bending brake to workpiece of differing and varying thicknesses and to facilitate locking and unlocking of the sheet material.

DESCRIPTION

Figure 1:
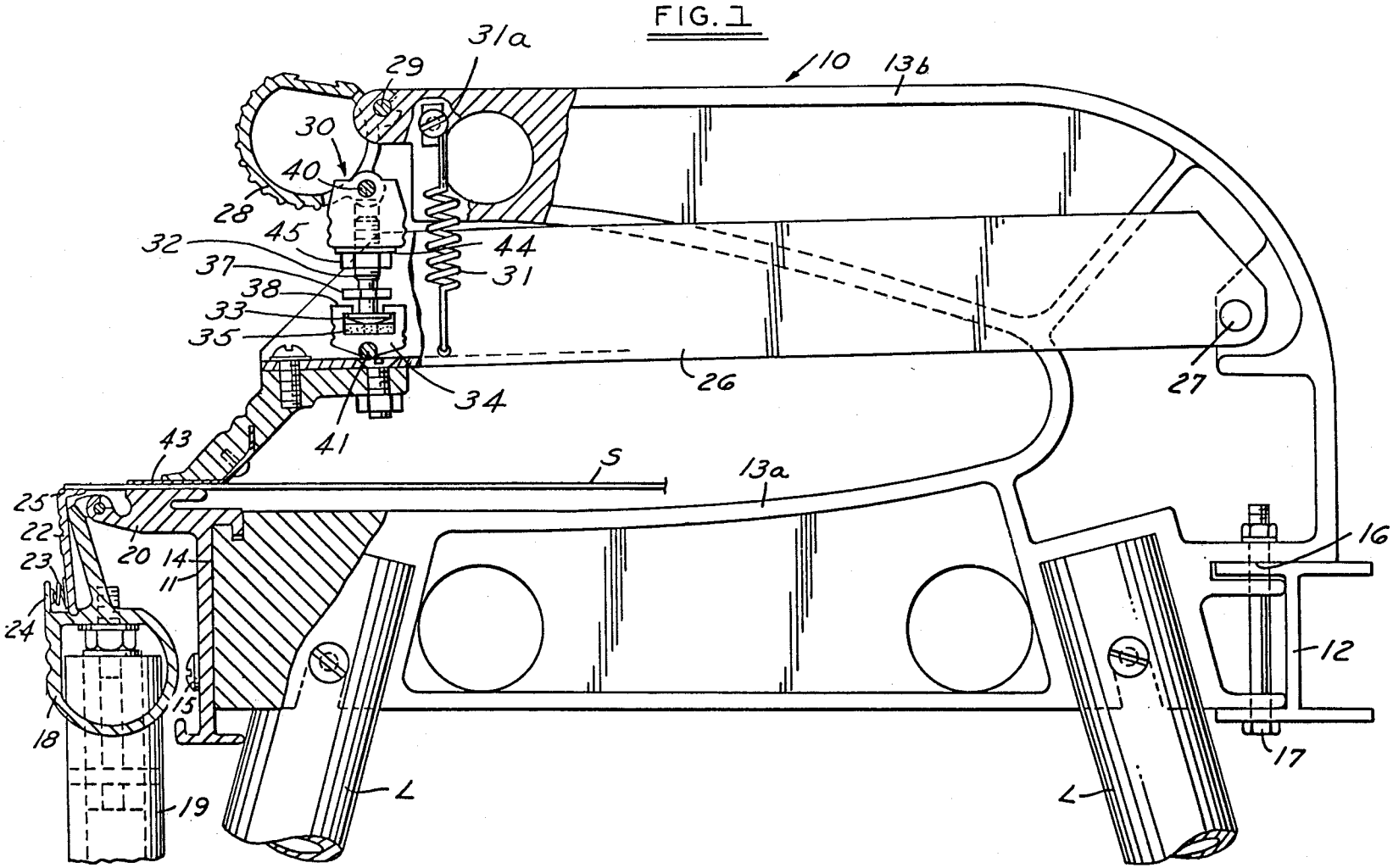
FIG. 1 is a fragmentary part sectional side elevational view of a sheet bending brake embodying the invention.
Figure 2:
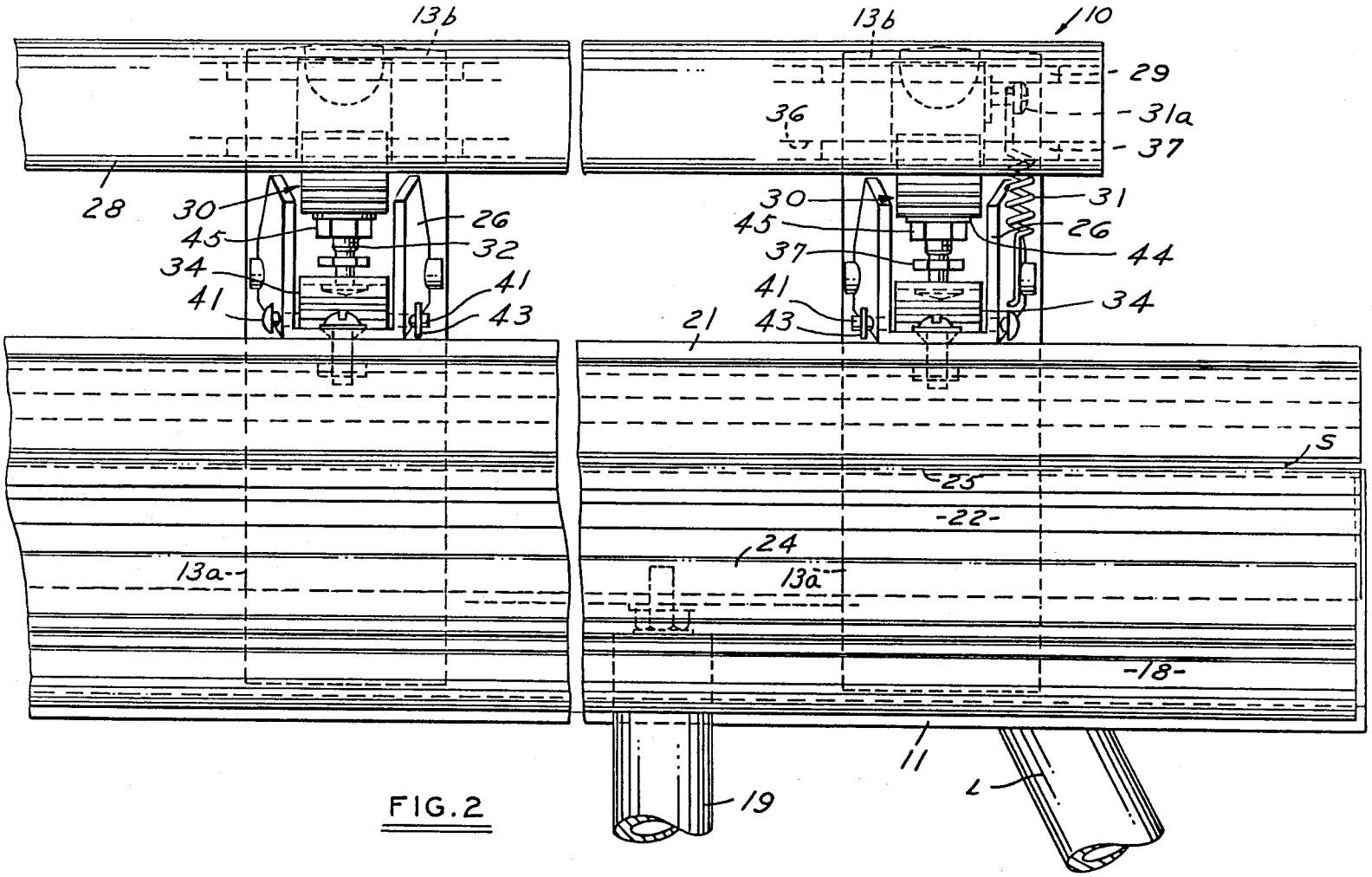
FIG. 2 is a fragmentary front elevational view of the same.

The brake embodying the invention comprises longitudinally spaced C-shaped frame members 10 connected by a front rail 11 and a rear rail 12. Each frame member 10 includes a lower arm 13*a* which is designed to define a front side face recess 14 to which rail 11 is bolted as by bolts 15 and a rear side face recess 16 to which I-shaped rail 12 is bolted as by bolts 17. Each C-frame member 10 also includes an upper arm 13*b* which overlies the lower arm 13*a* in spaced relation thereto. Tubular legs L extend into integral sockets in some of frames 10 to support the brake above the floor. A bending member 18 in the form of an aluminum extrusion is hinged to front rail 11 and one or more bending bar handle members 19 are fixed to the bending bar 18 for facilitating movement thereof. The upper portion 20 of front rail 11 is formed with a flat clamping surface.

Portion 20 and bending member 18 are formed with mating integral projections along their longitudinal edges, which projections are provided with openings co-axially aligned with the projections intermeshed and a pin extends through the openings to complete the hinge between bending member 18 and portion 20. Other types of hinges can be used.

An anvil member 21 is provided in overlying relation to the upper planar surface of portion 20.

A generally L-shaped floating hinge compensator 22 is pivoted to bending member 18 by engagement with a groove in bending member 18. Springs 23 are interposed between a lip 24 and compensator 22.

Hinge compensator 22 is provided along its opposite or outermost longitudinal edge with a foot portion 25 which is adapted to engage the sheet material.

As shown in FIG. 1, when the bending member 18 is out of bending position, the foot portion 25 of the hinge compensator 22 overlies the hinge connection and is disposed in a horizontal plane below that of the anvil member 21.

Figure 3:
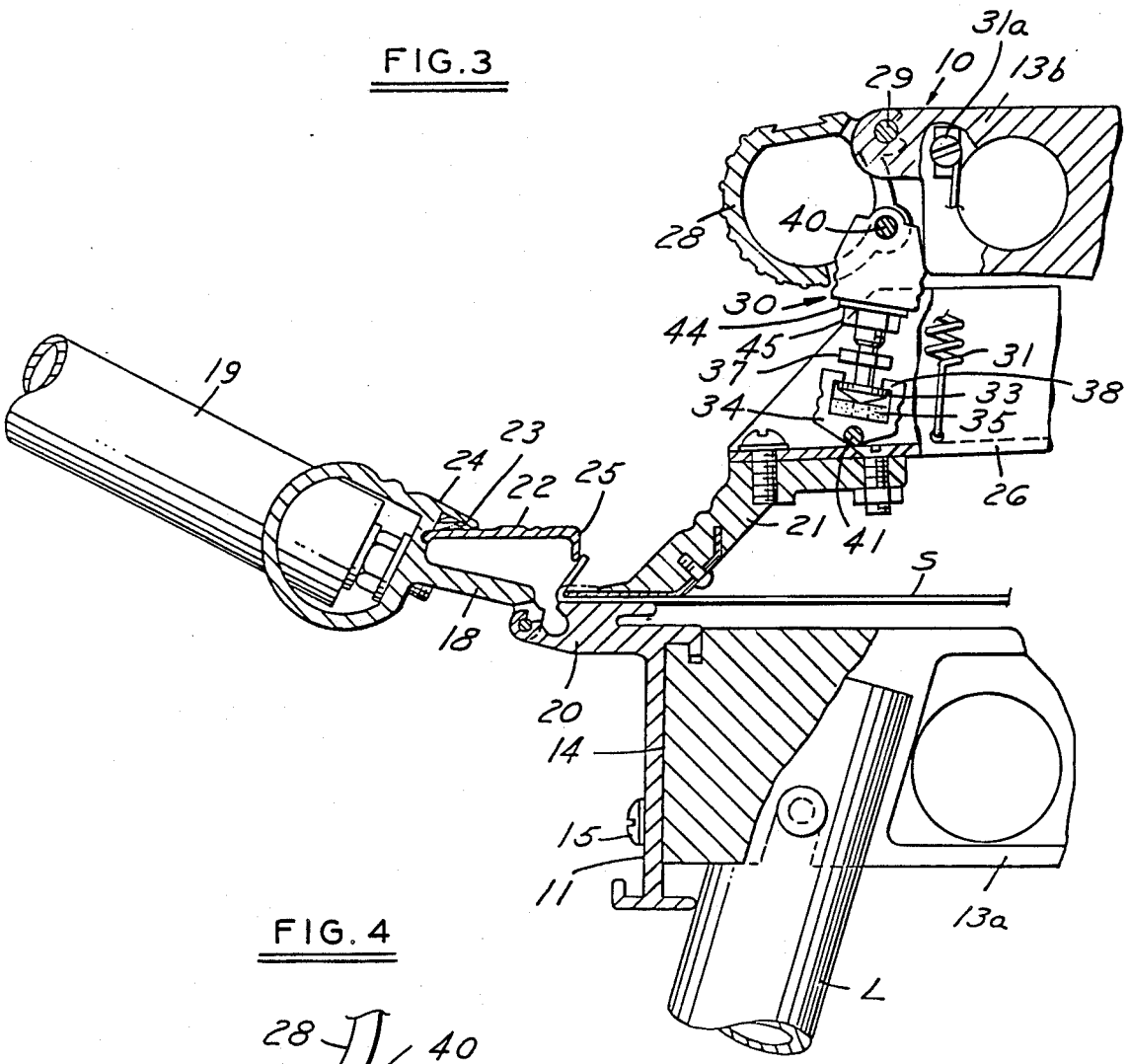
FIG. 3 is a fragmentary part sectional view similar to FIG. 1 on an enlarged scale showing the parts in a different operative position.

As the bending member 18 is swung upwardly from the position shown in FIG. 1 to the position shown in FIG. 3, the compensator 22 pivots with foot portion 25 thereof riding upwardly relative to the lower planar surface of the workpiece, which is clamped relative to the anvil 21 by a clamping subassembly presently described.

When the workpiece has been bent to the desired angular shape, the bending member 18 is swung downwardly whereupon the foot portion 25 of the compensator 22 rides downwardly to return to its normal position wherein it overlies the hinge connection. The compensator 22 thus serves to tend to minimize marring of the sheet and provide a continuous bending pressure to product the desired bend.

The clamping sub-assembly includes a channel-shaped pivot bar 26 on each frame 10 on which anvil 21 is fixed. Bar 26 is pivoted at its opposite innermost end to upper arm 13*b* of each C-frame 10 as by a pivot pin 27.

A handle member 28 is pivoted along one of its edges by a pivot pin 29 to the forward end of upper arm 13*b* of each C-frame 10 and is pivotally connected to pivot bar 26 by a plurality of extensible links 30 pivoted at its upper end to an edge of the handle member and at its lower end to the pivot bar 26.

A tension spring 31 is connected at one end to upper arm 13*b* by a screw 31*a* and at its opposite end to pivot bar 26 to yieldingly urge each bar 26 upwardly.

Figure 4:
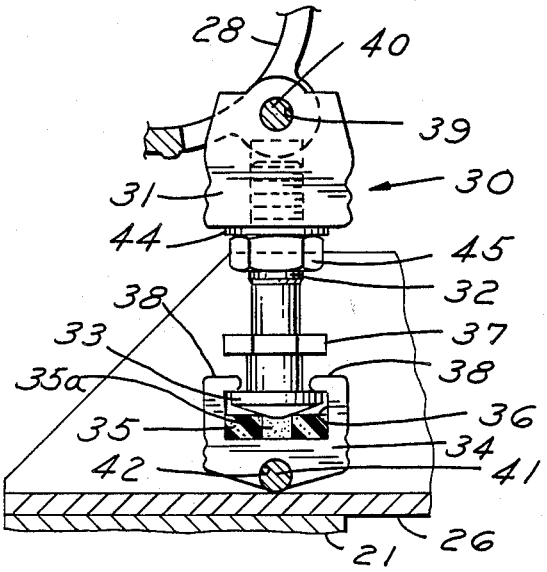
FIG. 4 is a fragmentary view on an enlarged scale of a portion of the sheet bending brake.

Referring to FIG. 4, in accordance with the invention, each extensible link 30 comprises an upper or first block 31, a shaft 32 threaded into block 31 and having an enlarged bead 33 extending into a lower or second block 34. The end surface of head 33 is preferably slightly tapered from the center to the periphery and engages a resilient pad 35 interposed between the head 33 and the base of a cavity 36 in the lower block 34 into which head 33 extends. Shaft 32 is preferably provided with a hexagonal portion 37 to facilitate grasping the shaft 32 for threading it axially relative to upper block 31 to adjust its length, either to make it shorter or longer. The cavity 36 is defined by a transverse opening through lower block 34 and block 33 includes inwardly directed flanges 38 which engage the upper surface of head 33 to retain it in position within cavity 36 in frictional engagement with the resilient pad 35. Pad 35 is preferably made of rubber having a durometer of 60 on the A scale. Link 30 is assembled by placing pad 35 in cavity 36 and sliding head 33 transversely into cavity 36 between the flanges 38 and pad 35. Resilient portion or pad 35 preferably includes a centrally located opening 35*a*. The apex of tapered surface of head 33 engages opening 35*a* to facilitate assembly by tending to maintain pad 35 centered with respect to head 33. It is believed that the opening 35*a* also functions to control the resiliency of the link.

The upper block 31 of extensible link 30 is formed with an opening 39 at its upper end through which a pin 40 is positioned and extends into an opening in handle member 28 to pivot extensible link 30 to the handle member 28. A headed pin 41 extends throughout the walls of bar 26 and engages the recess 42 in the lower block 34 along the base of bar 26 to pivot the lower block 34 to the bar 26. A spring metal fastener 43 maintains pin 42 in position. A lock washer 44 and lock unit 45 hold the extensible link in any adjusted position.

Manipulation of handle member 28 counterclockwise as viewed in FIG. 1 forces anvil 21 downwardly to clamp a sheet S to be bent on portion 20. During this movement, the link 30 is moved so that its pivot 40 passes under pivot 29 applying a resilient clamping force on an anvil 21 (FIG. 3). The upper arm forms a stop which is engaged by link 30 to control the locked position.

In use, a sheet S is properly positioned relative to lower arm 13*a* so that it rests upon portion 20 and foot portion 25 of hinge compensator 22. Handle member 28 is then swung downwardly to bring the clamping surface into contact with the upper planar surface of the sheet S and the handle member 28 is rotated to swing link 30 past center, thereby locking the anvil on the sheet S.

Bending bar handle member 19 is now swung upwardly to cause the foot portion 25 of the compensator 22 to pivot outwardly relative to bending member 18 thereby causing the workpiece to bend along the forward edges of the extension member.

When the sheet S has been bent to the desired angle, the handle member is swung downwardly and the compensator 22 returns to its rest position.

Provision of the individually adjustable axially adjustable links, each with a resilient portion permits each link to accommodate manufacturing variations or tolerances in the thickness of the sheet material being bent. In addition, the links permit each link to be adjusted to adjust the reaction or feel experienced by the operator during locking and unlocking. By extending the length of the link a more positive feel is obtained. Further where stiffer sheet material is to be bent, the links are lengthened to aid in producing a more sharp and even bend.

I claim:

1. A sheet bending brake comprising a frame, a fixed jaw mounted on said frame and extending longitudinally of said frame, a movable jaw pivoted to said frame, an anvil member secured to said movable jaw and extending longitudinally of said frame, said movable jaw having a clamping surface movable between workpiece clamping and non-clamping positions relative to the anvil member, a bending member hingedly connected to the fixed jaw, means for releasably locking the movable jaw in workpiece clamping position comprising a handle pivoted to said frame and extending longitudinally of said frame, a plurality of longitudinally spaced adjustable axially extensible links pivoted to said handle and said movable jaw, each said link having one end pivoted to said handle and the other end pivoted to said movable jaw such that in one position of said handle, said links hold said movable jaw out of clamping position and, in another position of said handle, said links hold said movable jaw in clamping position, each said link including a first part which is pivoted to said handle, a shaft threaded into said first part and having a free end and a second part pivoted to said movable jaw, each said second part supporting an axially compressible resilient pad interposed between the free end of said shaft and said second part to accommodate variations in thickness of said sheet material due to manufacturing tolerances, said shaft extending into said second part and engaging said resilient pad at all times, means extending between said shaft and said second part interconnecting said shaft and said second part and normally holding said shaft against said resilient pad, said first part, second part, pad and shaft of said link normally forming a solid connection between said handle and said movable jaw, said last-mentioned means limiting axial outward movement of said shaft relative to said second part and operable to lift said movable jaw out of clamping position and to hold said movable jaw out of clamping position, said last-mentioned means permitting axial inward movement of said shaft relative to said second part against the action of said resilient pad to compress said resilient pad sufficiently only to accommodate manufacturing variations and tolerances in the thickness of the sheet material when the jaw is in clamping position, said last-mentioned means comprising radially inwardly extending flange means on said second part engaging said shaft to provide the solid connection to limit axial outward movement of said shaft relative to said second part and to hold the jaw out of clamping position.

2. The sheet bending brake set forth in claim 14 wherein said shaft includes an enlarged head engaging said resilient pad, said flange means engaging said head.

3. The sheet bending brake set forth in claim 14 wherein said shaft includes means for grasping said shaft to thread said shaft into and out of said first part.

4. The sheet bending brake set forth in claim 14 wherein said frame includes a plurality of frame members, each having an upper arm and a lower arm, said handle being pivoted to said upper arm of said frame members, said movable jaw being pivoted on said frame members by a plurality of pivot bars on which the jaw is mounted, one of said links extending between each said pivot bar and said handle.

5. A sheet bending brake comprising a frame having a fixed jaw and a movable jaw, an anvil member secured to said fixed jaw, said movable jaw having a clamping surface movable between workpiece clamping and non-clamping positions relative to the anvil member, a bending member hingedly connected to the fixed jaw, means for releasably locking the movable jaw in workpiece clamping position comprising a plurality of axially extensible links, a handle pivoted to said frame, each said link being pivoted at one end to said handle and at the other end to said movable jaw such that in one position of said handle, said links move said movable jaw out of clamping position, and in another position of said handle, said movable jaw is in clamping position, each said link including an axially compressible resilient portion to accommodate variations in thickness of said sheet material due to manufacturing tolerances, said resilient portion comprising a block of resilient material, said link including a first part pivoted to said handle, a shaft threaded into said first part, a second part pivoted to said movable jaw, said second part supporting said resilient block, said shaft extending into said second part and engaging said resilient block, means extending between said shaft and said second part limiting axial outward movement and permitting axial inward movement between said second part and said shaft, said block having an opening therethrough, said link including a tapered end engaging said block.

* * * * *